United States Patent [19]

Naito

[11] Patent Number: 5,027,631

[45] Date of Patent: Jul. 2, 1991

[54] METHOD AND DEVICE FOR CONTROLLING THE STROKE OF A PRESS MACHINE

[75] Inventor: Kinshirou Naito, Isehara, Japan

[73] Assignee: Amada Company, Limited, Japan

[21] Appl. No.: 279,038

[22] Filed: Dec. 2, 1988

[30] Foreign Application Priority Data

Dec. 4, 1987 [JP] Japan ..... 62-305945
Dec. 4, 1987 [JP] Japan ..... 62-305947

[51] Int. Cl.[5] ..... B21J 9/20

[52] U.S. Cl. ..... 72/19; 72/21; 72/441; 72/443; 364/474.07

[58] Field of Search ..... 72/19, 20, 21, 28, 710, 72/443, 441, 10, 389; 364/474, 472, 476

[56] References Cited

U.S. PATENT DOCUMENTS

| | | | |
|---|---|---|---|
| 4,208,935 | 6/1980 | Kollmar | 83/617 |
| 4,408,471 | 10/1983 | Gossard et al. | 72/21 |
| 4,552,002 | 11/1985 | Haenni et al. | 72/19 |
| 4,747,283 | 5/1988 | Moore et al. | 72/21 |
| 4,819,467 | 4/1989 | Graf et al. | 72/21 |

FOREIGN PATENT DOCUMENTS

| | | |
|---|---|---|
| 0003745 | 9/1979 | European Pat. Off. . |
| 803669 | 9/1950 | United Kingdom . |
| 1517525 | 7/1978 | United Kingdom . |
| 2036923 | 7/1980 | United Kingdom . |
| 1586075 | 3/1981 | United Kingdom . |
| 2186394 | 8/1987 | United Kingdom . |

*Primary Examiner*—David Jones
*Attorney, Agent, or Firm*—Wigman & Cohen

[57] ABSTRACT

A method and device, for controlling a press machine, which creates an appropriate control pattern whereby high efficient processing is performed having low vibration and low noise and with operating efficiencies increased. This is accomplished based on the knowledge that the amount of vibration and noise are principles determined by the punching pressure. An appropriate punching velocity is selected from a table in accordance with a maximum punching pressure detected in a test punching operation, and then an appropriate control pattern of the stroke of a ram is created on the basis of the data detected in the test punching operation and the selected punching velocity.

10 Claims, 4 Drawing Sheets

FIG.2
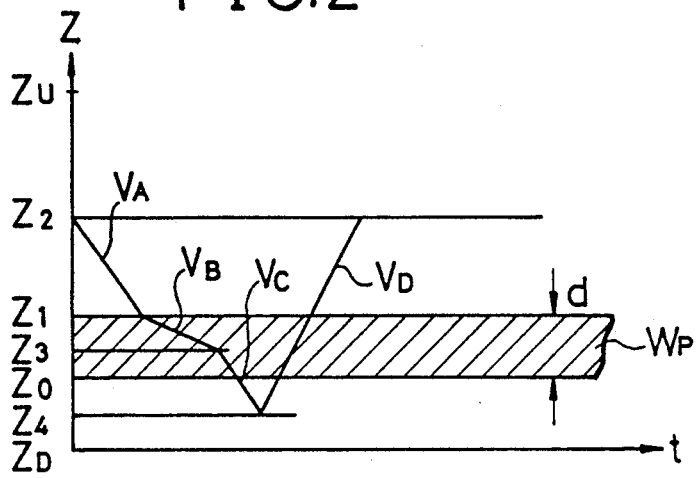
FIG.3
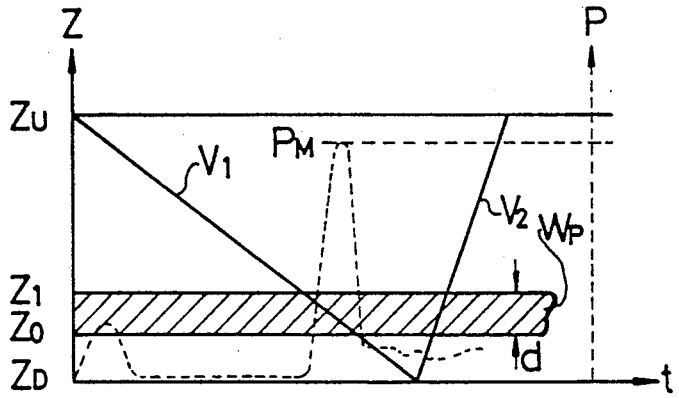
FIG.4
PUNCHING VELOCITY(DAY TIME) mm/s
| VB | APPLIED PRESSURE PM | | | | | | | |
|---|---|---|---|---|---|---|---|---|
| MATERIAL | --- | --- | 26.0 | 25.0 | 24.5 | --- | | --- |
| | --- | --- | --- | --- | --- | --- | | --- |
| | --- | --- | --- | --- | --- | --- | | --- |

METHOD AND DEVICE FOR CONTROLLING THE STROKE OF A PRESS MACHINE

BACKGROUND OF THE INVENTION

1. Field of the Invention

The present invention relates to a method and device for controlling the stroke of the ram of a press machine which moves in the vertical direction by means of a hydraulic cylinder, and, in particular, to a method and device for controlling the stroke of a press machine so that the operation of the press machine can be performed at high efficiency with low vibration and low noise.

2. Description of the Prior Art

An application for a method of controlling the stroke of the ram of a press machine has previously been made by the present applicant (Japanese Patent Application No. 61-25282), and the method of controlling the stroke of the ram of a press machine is known from laid open publication No. 62-183910.

A punching operation carried out by a press machine depends on the material of the workpiece, the plate thickness, and the punching velocity, but a large amount of noise and vibration are created in any cases.

For example, observations made on a turret punch press show that the vibration at a position 1 m away from the punch is about 75 dB, and at 10 m about 58dB. There is almost a linear relationship for the vibration in the interval between these points. In addition, the noise has been measured at about 98 dB at 10 m from the punch center and about 75 dB at 40 m. There is almost a linear relationship for the noise between these points.

This vibration and noise is produced by the friction between the stroke operating section and the plate material, and due to the deflection of the frame during the action of the stroke operating section. The greater the velocity of the stroke, the greater the amount of vibration and noise.

However, the control level for noise and vibration are determined by region and time of day, depending on the environmental control standards. Accordingly, the use of a press machine with a stroke operating section is severely restricted by time of day and by region, and in regions where the control is very strict it is necessary to provide elaborate anti-noise and antivibration devices.

Therefore, in the abovementioned previously known technology, technology is disclosed for carrying out a high efficiency process with low vibration and low noise by adjusting punching speed.

However, the principle by which vibration and noise are generated in the punching process is very complicated, and the appropriate value for the punching speed can only be obtained by actual observations. Accordingly, the appropriate value for the punching speed has been determined conventionally from test punch operations for type of material being processed, plate thickness and shape, or for each unit action. Accordingly, in the conventional technology, considerable time and trouble is required to create the appropriate speed and the overall operating efficiency is lowered.

In addition, conventional punch presses are constructed with the objective of performing the punching process. It is therefore difficult to perform a drawing process with such equipment.

However, in the case where one sheet of plate material contains a plurality of sections for drawing, and in the case where one sheet of plate material contains a mixture of sections for punching and sections for drawing, it is desirable to perform this drawing operation on a punch press.

SUMMARY OF THE INVENTION

An object of the present invention is to provide, with due consideration to the drawbacks of such conventional devices, a method and device for controlling a press machine which creates appropriate control pattern in which the high efficient processing is performed with low vibration and low noise and the operating efficiency can be increased. This invention is accomplished based on the knowledge that the amount of vibration and noise are in principles determined by the punching pressure.

A further object of the present invention is to provide a method and device for controlling the stroke of a press machine in carrying out the forming processes such as the punching and drawing of a workpiece with little noise and vibration.

BRIEF DESCRIPTION OF THE DRAWINGS

These and other objects, features, and advantages of the present invention will become more apparent from the following description of the preferred embodiments taken in conjunction with the accompanying drawings, in which:

FIG. 2 is an explanatory drawing of a control pattern.

FIG. 3 is an explanatory drawing of a test for punching a plate.

FIG. 4 is an explanatory drawing showing a data table.

DETAILED DESCRIPTION OF THE PREFERRED EMBODIMENTS

Figure 1:
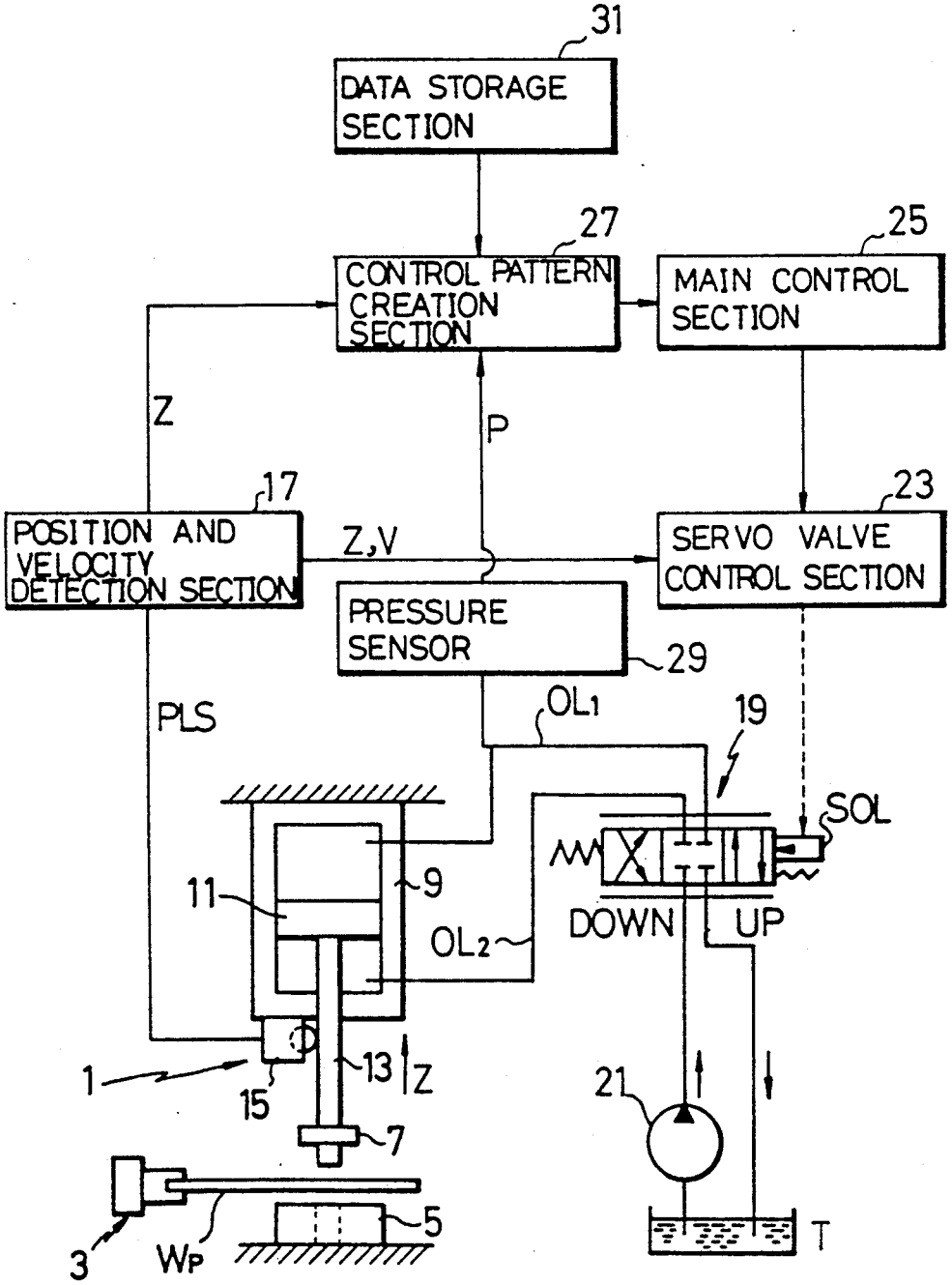
FIG. 1 is an explanatory drawing showing a model of a press machine and its control device.

Now referring to FIG. 1, on a punch press 1, for example, in the same way as in an ordinary turret punch press, a workpiece moving and positioning device 3 is provided for moving and positioning a workpiece WP in the form of a plate, in both the X-axis and Y-axis directions. The workpiece moving and positioning device 3 can be of a commonly known construction so it is shown as a schematic drawing only and an explanation of the construction details is therefore omitted.

In addition, in the punch press 1 there are provided a die 5 which carries out a process on the workpiece WP and a punch 7 which acts in conjunction with the die 5. As is commonly known, in the turret punch press, for example, a plurality of dies 5 and the punches 7 are provided on a lower turret and an upper turret. These dies 5 and the punches 7 are commonly known so that they are shown as a schematic drawing only. An explanation of the construction details is therefore omitted.

In the punch press 1, a hydraulic cylinder 9 is provided to apply pressure to the punch 7. The hydraulic cylinder 9 is mounted on an upper frame (omitted from the drawing) of the punch press 1, and is of a structure such that, by means of the vertical activation (in the Z direction) of a piston 11 provided in its internal section, a ram 13 such as a piston rod is activated in the vertical direction and pressure is applied to the punch 7.

A position detection device 15 is provided on the hydraulic cylinder 9 for detecting the vertical position of the ram 13. The position detection device 15 can be, for example, a pulse encoder which outputs a pulse signal PLS proportional to the velocity of movement of the ram 3. The pulse signal PLS output by the position detection device 15 is input to a position and velocity detection section 17. The position and velocity detection section 17, by counting the number of the pulse signals PLS, detects the vertical movement position of the ram 13 and, for example, by counting the number of pulse signals PLS per unit time, it detects the movement velocity corresponding to the vertical movement position of the ram 13.

A servo valve 19 is connected to a vertical pressure chamber in the cylinder 9, through a plurality of oil circuits OL1 and OL2. The servo valve 19 controls the volume of hydraulic fluid discharged to a tank T from hydraulic pump 21 or the volume of hydraulic fluid supplied to the hydraulic cylinder 9 from a hydraulic pump 21. A solenoid valve SOL is activated in proportion to the magnitude of an imposed electrical current to control the volume of flow of the hydraulic fluid.

A servo valve control section 23 is provided to control the servo valve 19. The position and velocity detection section 17 and a main control section 25 are connected to the servo valve control section 23. Here, the displacement of the servo valve spool may be fed back to the servo valve control section 23. A control pattern creation section 27 is provided to create the control pattern set in the main control section 25. The position and velocity detection section 17 and a pressure sensor 29 which detects the pressure in the upper part of the hydraulic cylinder 9 are connected to the control pattern creation section 27. A data storage section 31 is also connected to the control pattern creation section 27.

The control pattern creation section 27 creates the control pattern based on the position data Z input from the position and velocity detection section 17, the pressure data P input from the pressure sensor 29, and the data stored in the data storage section 31. The control pattern created in the control pattern creation section 27 is a control pattern, for example, of the type shown in FIG. 2. The control pattern is stipulated from a velocity $V_A$ of an approach interval, a velocity $V_B$ of a process interval, a velocity Vc of a strike interval, and a velocity $V_D$ of a return interval.

The approach interval extends from a descent starting position $Z_2$ of the ram 13 to the position at which the punch comes extremely close to, or is on the point of contacting the top surface of the workpiece WP of a plate thickness d (a position $Z_1$), where the velocity Va is set at a high velocity.

The process interval is the interval from the position $Z_1$ to a position $Z_3$. The position $Z_3$ is the position of the bottom surface of the workpiece WP when the thickness of the plate of the workpiece WP is, for example, less than 2 mm, or a position which is a prescribed dimension (for example, 2 mm) below the top surface of the workpiece WP when the thickness of the plate is 2 mm or greater. The velocity Vb in the process interval is set at a low velocity at which the noise and vibration can be controlled.

The finish interval is the interval from the position $Z_3$, to a position $Z_4$ at a prescribed dimension below a position $Z_0$ which is the bottom surface of the workpiece WP. The velocity Vc in the strike interval is set at a high velocity.

The return interval is the interval from the lowest position $Z_4$ to the starting position $Z_2$. The return velocity Vd in the return interval is set at the maximum velocity.

Creating the control pattern in the control pattern creation section 27 is generally carried out by a test punching process. Specifically, as shown in FIG. 3, the hydraulic cylinder 9 is activated, the ram 13 descends at a comparatively low velocity $V_1$ from the top position Zu toward the bottom position $Z_D$. The ram 13 then returns at a comparatively high velocity $V_2$ from the bottom position $Z_D$ toward the top position Zu, and an experimental punching operation is performed.

When the punching operation is carried out in this manner, the punch 7 descends by means of the ram 13. At the position $Z_1$ at which it contacts the upper surface of the workpiece WP, the pressure in the pressurized space of the hydraulic cylinder 9 is increased (shown by the dotted line in the pressure (P), time (t) diagram), so that both the build-up of the pressure P and the maximum punching pressure Pm are detected by the pressure sensor 29.

Accordingly, the control pattern creating section 27 reads the top surface position $Z_1$ of the workpiece WP from the position of the punch 7 at the pressure P at the time of the pressure build-up as well as reading the maximum punching pressure Pm, and records them.

After the top surface position of the workpiece WP is detected, in the control pattern creation section 27, the velocity Va of the approach interval shown in FIG. 2 is set at an acceptable high velocity. Next, the velocity Vb is selected from the data in the table shown in FIG. 4.

The data in the table of FIG. 4 indicates the values of velocity for the specified punching force so that levels of the vibration and the noise do not exceed the legal restrictions. The data for the punching velocity is drawn up in advance from actual tests. It is classified according to the workpiece material and time period, and is stored in the data storage section 31.

In this way, after the velocity Vb for the process interval has been selected, based on the known plate thickness d of the workpiece WP, the position $Z_3$ where the velocity of the ram is changed to velocity $V_c$ is determined; and also the velocity Vc is determined to be an acceptable high velocity. Next, the velocity Vd of the return interval is set at the maximum velocity, and the control pattern is created as shown in FIG. 2.

In this way, the control pattern created in the control pattern creation section 27 is transmitted to the main control section 25 as previously outlined, and the servo valve 19 is controlled according to the control pattern so that the action of the hydraulic cylinder 9 is controlled.

It can therefore be understood that in this embodiment of the present invention the punching velocity Vb is selected according to the test data for the noise and vibration related to the prescribed punching force and punching velocity. Therefore, by the selection of optional punching velocities Vb and the creation of the control pattern it is possible to control the noise and vibration to an acceptable level for the surrounding environment, and an improvement in productivity is effectively provided.

In this embodiment of the present invention only the punching velocity Vb is extracted from the data in the table and the control pattern is created. However, it is acceptable to prepare the data table for the control pattern for each value of the plate thickness d in advance and select the control pattern itself from the table. In addition, it is acceptable to omit the data storage section 31, calculate the punching force for each hole, and input the acceptable punching velocity for this punching force.

Figure 5:
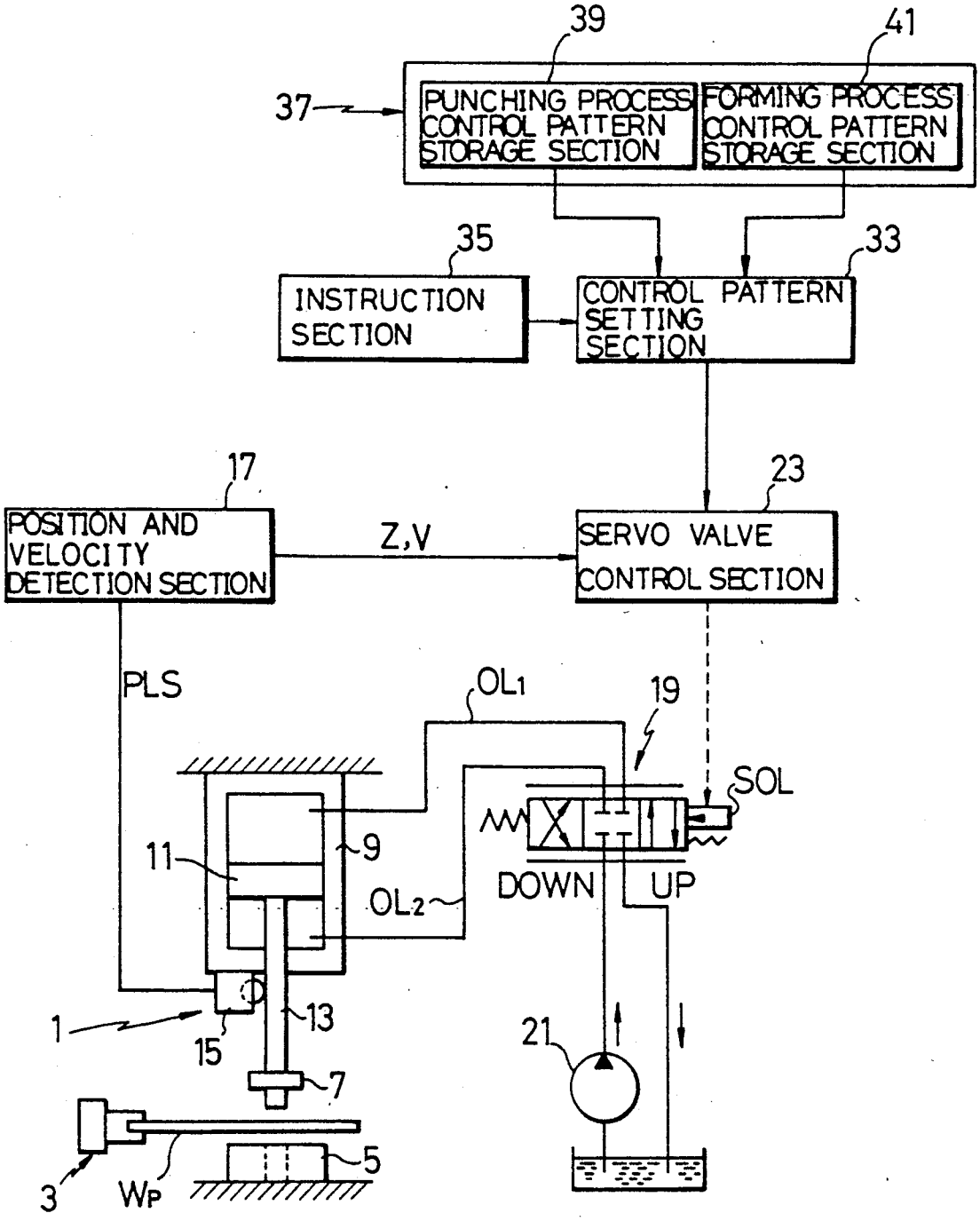
FIG. 5 is an explanatory drawing showing a second embodiment of a control device.

FIG. 5 shows a second embodiment of the present invention in which each type of control pattern data is prepared in advance, the prescribed control pattern is selected, and the hydraulic cylinder 9 is controlled.

In this second embodiment of the present invention, a control pattern setting section 33 is connected to the servo valve control section 23 in place of the main control section 25 of the previous embodiment. An instruction section 35 and a memory section 37 are connected to the control pattern setting section 33. The memory section 37 stores various types of control patterns for controlling the vertical motion of the ram 13. The memory sections 37 comprises, a punching process control pattern storage section 39, which stores various types of control patterns for the case where the workpiece WP is punched, and a forming process control pattern storage section 41, which stores various types of control patterns for a shaping process such as, for example, a drawing process and the like.

The various types of punching process control patterns used when a punching process is carried out on the workpiece WP, such as the control pattern of FIG. 2, for example, are stored in the punching process control pattern storage section 39.

Figure 6:
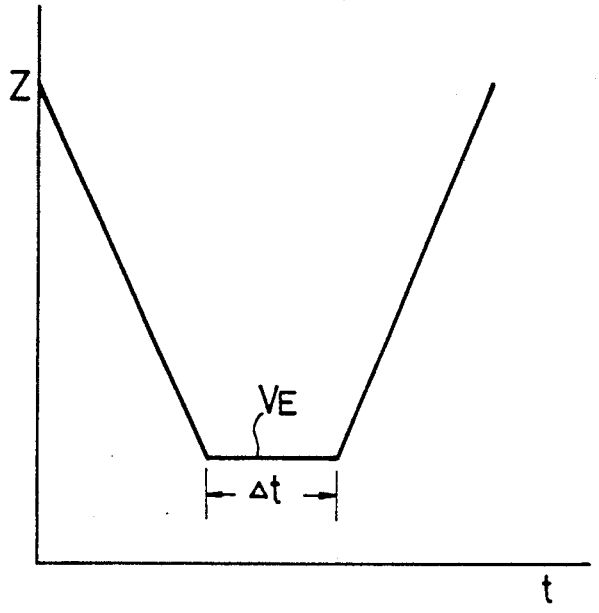
FIG. 6(A) 6(B) are explanatory drawings of control patterns.
Figure 6:
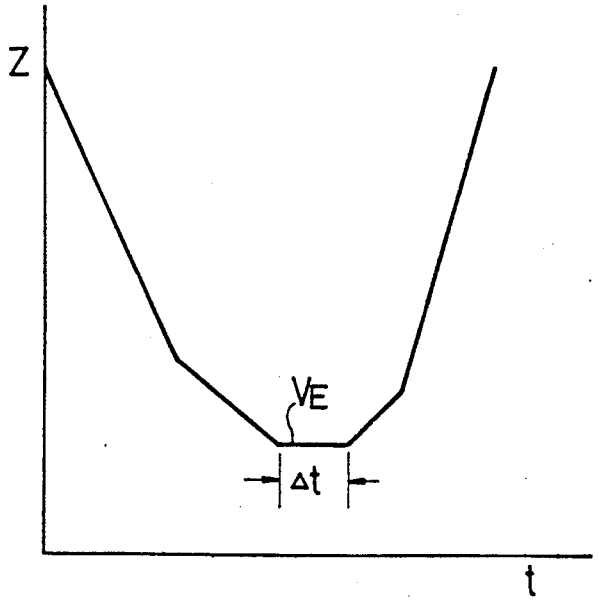

Various types of control patterns, such as shown in FIG. 6(A) and FIG. 6(B), for example, are stored in the shaping process control pattern storage section 41. The control pattern shown in FIG. 6(A) is a suitable control pattern for performing a drawing process on the workpiece WP. The difference between this pattern and the previously mentioned punching process control pattern is that, after the drawing process, the pattern of FIG. 6(A) has a holding time $\Delta t$ during which the ram 13 is maintained at a constant pressure or in a fixed position (velocity $V_E=0$). In addition, in the case where the the surface of workpiece WP is stamped, the positioning of the descending edge of the punch must be highly precise. For this reason, it is desirable that the control pattern, as shown in FIG. 6(B), should have a low velocity immediately before reaching bottom end.

Specifically, in a forming process which does not involve punching the workpiece WP, a condition occurs where the localized stress of the workpiece WP is dispersed, the mobility of the workpiece WP is stable, and the warp and distortion of the workpiece WP can be suppressed by maintaining the ram 13 and the punch 7 for a desired time interval $\Delta t$ with a fixed pressure or fixed position at the point where the process is completed.

In the configuration of this second embodiment of the present invention, either the punching process control pattern storage section 39 or the forming process control pattern storage section 41 is retrieved when the specified punching process or forming process is called by the instruction section 35 which reads the program to find out whether the punching process or forming process is selected therein. Then the specified control pattern is set in the control pattern setting section 33. When the specified control pattern is set in the control pattern setting section 33, the servo valve 19 is controlled by the set control pattern while the servo valve control section 23 is utilizing the positional and velocity data Z, V which is input from the position and velocity detection section 17, and controls the action of the hydraulic cylinder 9.

Specifically, by means of this embodiment of the present invention, the various types of control patterns stored in the punching process control pattern storage section 39 or the shaping process control pattern storage section 41 are selected, and the action of the hydraulic cylinder is controlled by means of the selected control pattern so that the punching process or forming process is easily performed on the workpiece WP. In addition, because it is not necessary to again create a control pattern, it is possible to quickly cope with each type of process control.

As can be understood from the above explanation, by means of the present invention, the punching operation can be performed by the desired control pattern. Noise and vibration are suppressed according to regional and time related regulations, and it is possible to carry out both the punching process and the punching process together with a high quality forming process.

What is claimed is:

1. A method of controlling the stroke of a cylinder type press machine in which the velocity of the stroke of a ram can be variably controlled, comprising the steps of:

(a) detecting data of a punching pressure applied to a cylinder and vertical position of the ram, when a test punching operation is performed;

(b) selecting an appropriate punching velocity from a table, in which data on the relations between the punching velocity and the punching pressure on a workpiece are recorded so that values of vibration and noise do not exceed the legal regulations, in accordance with the punching pressure detected in the test punching operation;

(c) creating a control pattern of the stroke of the ram based on the data detected in the step (a) and the punching velocity selected in the step (b), so that the workpiece is punched at desired value of vibration and noise when the ram is controlled by means of the control pattern; and (d) controlling the ram by means of the created control pattern.

2. The method of controlling the stroke of a press machine of claim 1 wherein the control pattern comprises:

an approach interval from the initial position of the stroke of the ram to where the ram reaches the workpiece;

a process interval during which pressure is applied to the workpiece;

a strike interval wherein the scrap after the punching and the product are knocked out;

a return interval following the striking; and wherein velocity value is stipulated for each interval.

3. The method of controlling the stroke of a press machine of claim 2 wherein the approach interval is stipulated as a comparatively short fixed distance from the surface of the workpiece.

4. The method of controlling the stroke of a press machine of claim 2 wherein, for the process interval, the width and length is set for a workpiece of less than a specified thickness, and a fixed length is set for a workpiece greater than a specified thickness.

5. The method of controlling the stroke of a press machine of claim 2 wherein the trailing edge of the strike interval is set at a position which is a fixed distance from the surface of the workpiece.

6. A device for controlling the stroke of a press machine comprising:

a servo valve for controlling a hydraulic cylinder which in turn controls the vertical motion of a ram;

a servo valve control section which controls the servo valve;

a position detection section which detects the vertical position of the ram;

a pressure sensor which detects the pressure in the hydraulic cylinder;

a data storage section in which stores a table on the relations between the punching velocity and the punching pressure on a workpiece so that values of vibration and noise during punching operations do not exceed the legal regulations;

a control pattern creation section which selects an appropriate punching velocity from the table stored in the data storage section in accordance with the punching pressure detected by the pressure sensor and creates a control pattern which controls the stroke of the ram based on the selected punching velocity and the input from the position detection section, the pressure sensor, and the data storage section; and a main control section which controls the servo valve according to the control pattern created in the control pattern creation section.

7. The device for controlling the stroke of a press machine of claim 6 wherein the control pattern comprises: an approach interval from the initial position of the stroke of the ram to where the ram reaches the workpiece;

a process interval during which pressure is applied to the workpiece;

a strike interval wherein the scrap after the punching and the product are knocked out;

a return interval following the striking; and wherein velocity value is stipulated for each interval.

8. The device for controlling the stroke of a press machine of claim 7: wherein the approach interval is stipulated as a comparatively short fixed distance from the surface of the workpiece.

9. The device for controlling the stroke of a press machine of claim 8: wherein for the process interval, the width and length is set for a workpiece of less than a specified thickness, and a fixed length is set for a workpiece greater than a specified thickness.

10. The device for controlling the stroke of a press machine of claim 9: wherein the trailing edge of the strike interval is set at a position which is a fixed distance from the surface of the workpiece.

* * * * *